United States Patent [19]

Siebenhofer et al.

[11] 4,147,391

[45] Apr. 3, 1979

[54] SWIVEL MECHANISM FOR KERF-CUTTING MACHINES

[75] Inventors: Gottfried Siebenhofer, Vienna; Manfred Mülner; Walter Arbeithuber, both of Zeltweg, all of Austria

[73] Assignee: Vereinigte Osterreichische Eisen- und Stahlwerke - Alpine Montan Aktiengesellschaft, Vienna, Austria

[21] Appl. No.: 854,025

[22] Filed: Nov. 22, 1977

[30] Foreign Application Priority Data

Dec. 1, 1976 [AT] Austria ..... 8903/76

[51] Int. Cl.[2] ..... E21C 31/10

[52] U.S. Cl. ..... 299/75

[58] Field of Search ..... 299/73–75

[56] References Cited

U.S. PATENT DOCUMENTS

| | | | |
|---|---|---|---|
| 2,776,809 | 1/1957 | Barrett | 299/73 X |
| 2,826,923 | 3/1958 | Sibley | 299/75 X |

*Primary Examiner*—Ernest R. Purser

*Attorney, Agent, or Firm*—Cushman, Darby & Cushman

[57] ABSTRACT

A swivel mechanism for kerf-cutting machines comprising a cutter arm, which carries the cutting tool, in which mechanism the cutter arm is pivoted to a swivel head on a horizontal axis for a vertical angular movement, said swivel head is pivoted on an approximately vertical axis to a bearing disc, which is rigidly connected to the frame of the cutting machine and has an outer annular zone that is engaged on both sides by sliding surfaces of the swivel head, and swivel drive means are provided for imparting angular movements to the swivel head, characterized in that the swivel drive means comprise two racks, which are mounted in the swivel head for movement in mutually opposite directions, which are parallel to the vertical center plane of the cutter arm, and a pinion is connected to and coaxial with the bearing disc and is in mesh with said racks at diametrically opposite points of said pinion.

3 Claims, 5 Drawing Figures

SWIVEL MECHANISM FOR KERF-CUTTING MACHINES

Kerf-cutting machines have a cutter arm, which is connected to the frame of the machine by a swivel mechanism for angular movements in vertical and horizontal directions. The cutter arm is highly stressed because the cutting tool mounted at the free end of the cutter arm must exert a high cutting pressure. The swivel mechanism which carries the cutter arm must be designed to withstand said high stresses. The stresses on the swivel mechanism are increased by the rough usage in the mine and by the dust which has been raised. For this reason the known swivel mechanisms are subjected to heavy wear and liable to be deranged. It is known to mount the swivel mechanism on a bearing disc, which is rigidly connected to the frame of the cutting machine and large in diameter and which is engaged at its outer annular zone on both sides by sliding surfaces of the swivel head. Such bearing disc takes up vertical axial forces. The tilting forces exerted by the cutter arm are also taken up as vertical forces by the bearing disc because it is large in diameter. On the other hand, the working pressure of the cutting tool causes considerable forces to be exerted, which act radially on the bearing disc and which in such known arrangement are taken up by a radial bearing, which is spaced below the bearing disc. In that known arrangement the swivel drive means for imparting angular movements to the swivel mechanism comprise a rack, which extends transversely to the longitudinal direction of the cutter arm and cooperates with a pinion, which is keyed to the pivoted part of the swivel mechanism. That radial bearing is disposed close to the pinion so that the latter is properly held in mesh with the rack. Such arrangement thus requires two bearings, which consist of the bearing disc and the radial bearing. Because hydraulic actuators for imparting a vertical angular movement to the cutter arms are provided between the bearing disc and the radial bearing, the pinion in mesh with the rack must be disposed below the radial bearing. The provision of the bearing disc, the hydraulic actuators for imparting a vertical angular movement to the cutter arm, the radial bearing and the pinion cooperating with the rack results in a very large overall height of the swivel mechanism.

This invention relates to such swivel mechanism in which the cutter arm is mounted on the swivel head for vertical angular movement in height about a horizontal axis and the swivel head is pivoted on an approximately vertical axis to a bearing disc, which is rigidly connected to the frame of the cutting machine and at its outer annular zone is engaged on both sides by sliding surfaces of the swivel head, and in which swivel drive means are provided for imparting angular movements to the swivel head. The invention resides in that the swivel drive means comprise two racks, which are mounted in the swivel head for movement in mutually opposite directions, which are parallel to the vertical center plane of the cutter arm, and a pinion is connected to and coaxial with the bearing disc and is in mesh with said racks at diametrically opposite points of said pinion. Because two racks are provided for imparting to the cutter arm an angular movement about the vertical axis, these racks are parallel and symmetric to the center plane of the cutter arm, and a pinion connected to the bearing disc is in mesh with said racks at diametrically opposite points of said pinion, the forces which act in the longitudinal direction of the cutter arm and radially with respect to the axis of the bearing disc are taken up by these two racks as pressures on the tooth flanks and/or tooth faces. Because the racks are mounted in the swivel head they are always parallel to the vertical longitudinal center plane of the cutter arm so that the forces acting in the longitudinal direction of the cutter arm act in the longitudinal direction of the racks in all positions of the cutter arm and it is ensured that these forces will be taken up satisfactorily. As a result, there is no longer a need for a radial bearing for taking up the forces acting in the longitudinal direction of the cutter arm so that the overall height of the swivel mechanism is greatly reduced.

In accordance with the invention, each rack is connected to at least one piston member of a hydraulic actuator and each working chamber adjoining a piston member for actuating one rack is in hydraulic communication with the opposite working chamber adjoining a piston member for actuating the other racks. This arrangement ensures a uniform load on the tooth flanks and/or tooth faces of the two racks so that the forces acting in the longitudinal direction of the cutter arm are uniformly taken up.

In a preferred embodiment of the invention the piston means for actuating each rack consist of two coaxial piston members, which are connected by the rack, each of said piston member is adapted to be subjected to hydraulic pressure only at one end, and the working chambers associated with said piston members are adjoined by those end faces thereof which are remote from the rack. This results in a simple structure, in which the forces exerted by the piston means are directly and coaxially transmitted to the rack. The pinion which is coaxially connected to the bearing disc is suitably disposed closely above the mounting disc. Because the pinion is disposed above the mounting disc, the latter can be arranged on the lowest possible level relative to the frame of the cutting machine. Because the axial distance between the pinion and bearing disc is minimized, corner stresses will be minimized too. The outside diameter of the bearing disc preferably exceeds the pitch diameter of the pinion, because the quality of the bearing will be improved by a bearing disc which is large in diameter. The tilting loads exerted by the cutter arm can be taken up by the bearing disc in an improved manner as the diameter of the bearing disc is increased. The pressures exerted on the tooth flanks and/or faces of the pinion and of the rack as a result of the forces exerted in the longitudinal direction of the cutter arm are independent from the pitch diameter of the pinion. As the racks are disposed outside the pitch diameter, the pitch diameter of the pinion need not be smaller than the outside diameter of the bearing disc. As a result, the racks and the means for driving them need not result in overall dimensions which are larger, or substantially larger, than those which are due to the diameter of the bearing disc.

In accordance with the invention the bearing disc and the pinion are suitably disposed in a top plan view between two hydraulic actuators which serve to impart a vertical angular movement to the cutter arm about the horizontal axis. The larger radial distance of these actuators from the pivotal axis has the advantage that the forces to be exerted may be smaller and the overall height of the swivel mechanism can be reduced. In a favorable design, the bearing disc and the pinion are annular and screw-connected to a pedestal, which is rigidly connected to the frame of the cutting machine.

An embodiment of the invention is shown diagrammatically and by way of example of the drawing.

Figure 1:
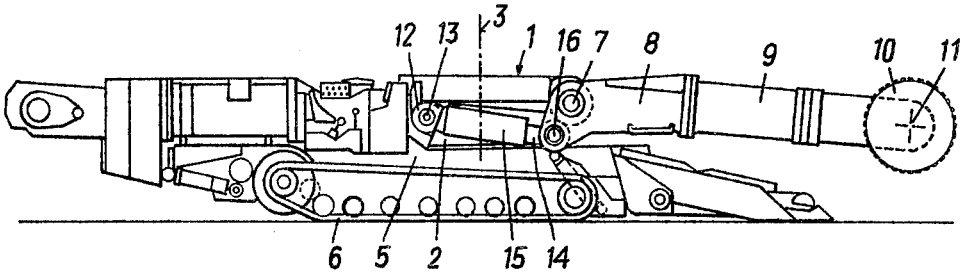
FIGS. 1 and 2 are a side elevation and a top plan view, respectively, which show the cutting machine.
Figure 2:
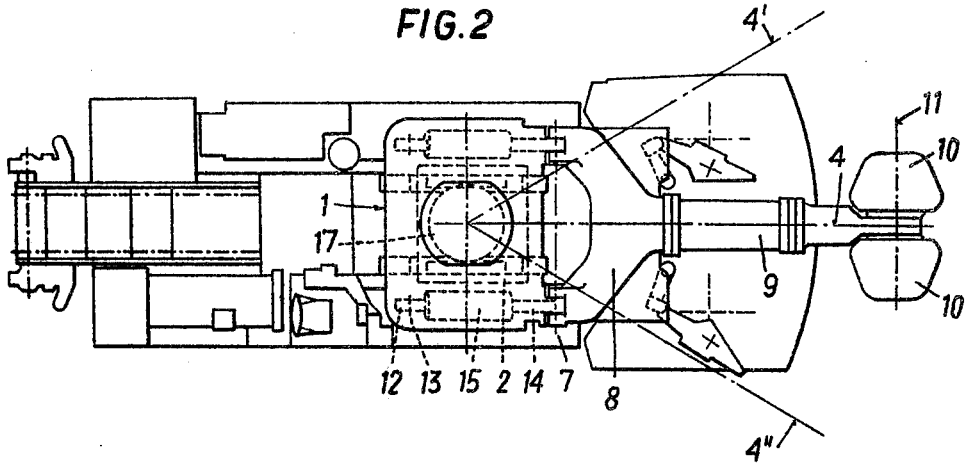

The swivel head 1 is pivoted to a pedestal 2 on an approximately vertical axis 3. The pedestal 2 is rigidly secured to the frame 5 of the kerf-cutting machine, which is movable on crawler tracks 6. A bridge 8 is pivoted to the swivel head 1 on an approximately horizontal axis 7 and carries the cutter arm 9. A rotary cutter head 10 is mounted for rotation on a horizontal axis 11 at the free end of the cutter arm 9. The swivel head is provided at its other end with eye lugs 12, to which the hydraulic actuators 15 are pivoted by a pin 13. The pistons 14 of the actuators 15 are connected to the bridge 8 by a pin 16. These hydraulic actuators 15 serve to impart an angular movement to the cutter arm 9 about the horizontal axis 7. The axis 4 of the cutter arm 9 is angularly movable to both sides through about 30° to positions 4' and 4''.

Figure 5:
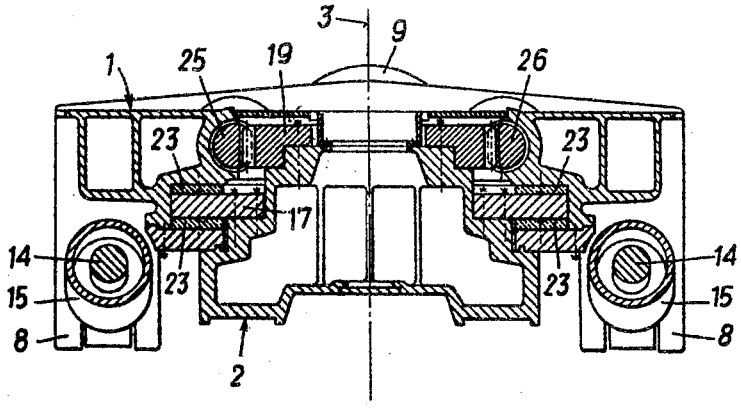
FIG. 5 is a sectional view taken on line V—V in FIG. 4.
Figure 3:
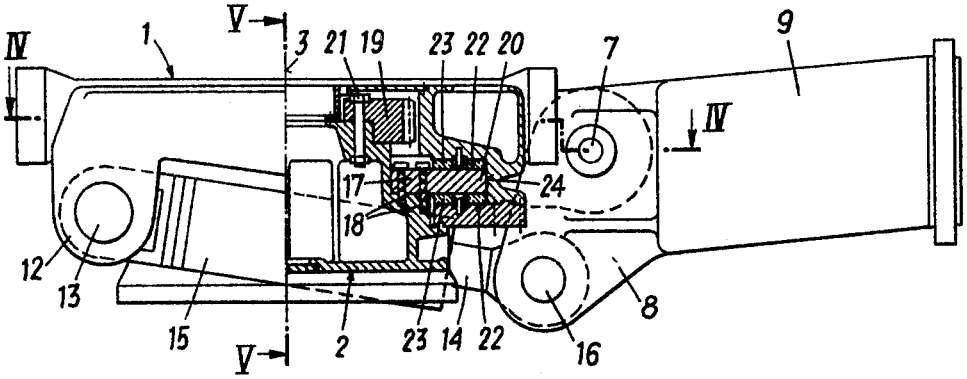
FIG. 3 is a longitudinal sectional view taken on line III—III in FIG. 4 and showing the swivel mechanism and the pivoted end of the cutter arm.
Figure 4:
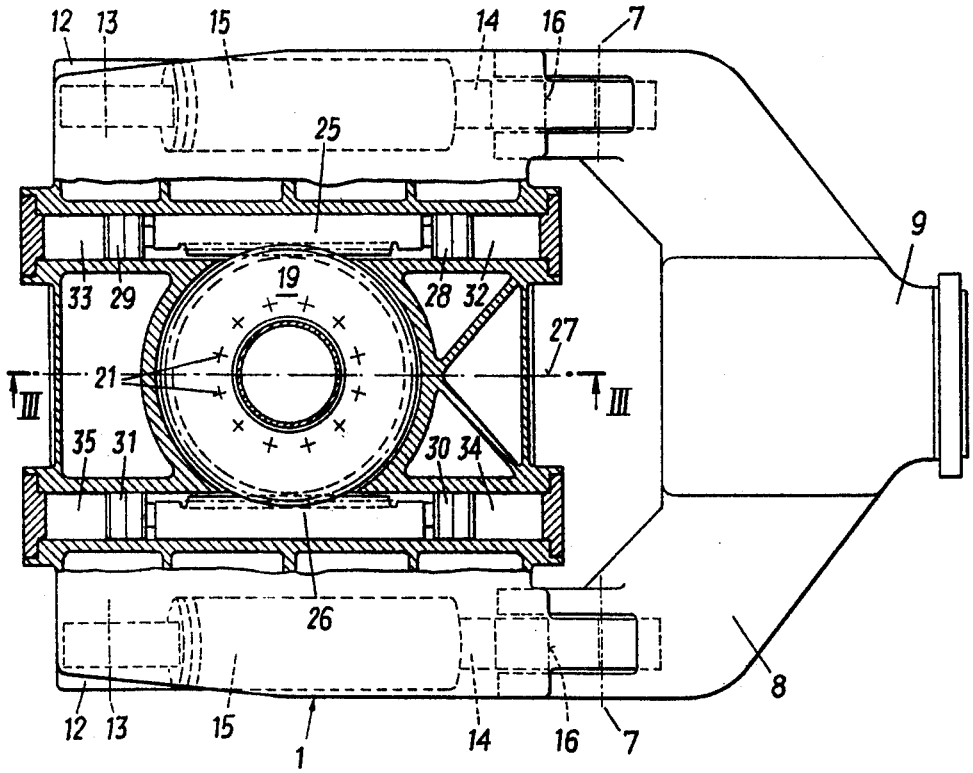
FIG. 4 is partly a top plan view and partly a horizontal sectional view taken on line IV—IV in FIG. 3 and showing the swivel mechanism.

The swivel mechanism comprising the swivel head 1 and the pedestal 2 is shown on a larger scale more in detail in FIGS. 3 to 5. An annular bearing disc 17 is connected by screws 18 to the pedestal 2, which is rigidly connected to the frame 5. An annular pinion 19 is also connected to the pedestal 2 by bolts 21. The bearing disc 17 and the annular pinion 19 are thus rigidly connected to the frame 5 of the cutting machine. The swivel head 1 engages the outer annular zone 20 of the bearing disc 17 on both sides. The sliding surfaces 22 of the swivel head 1 which bear on the outer annular zone 20 of the bearing disc 17 consist of facings 23 of plastics material. There may be a certain clearance between the outside circumference of the bearing disc 17 and the swivel head 1 or said outside circumference 24 may contact the swivel head 1.

Two racks 25 and 26 are longitudinally slidably mounted in the swivel head 1 and in mesh with the pinion 19 at diametrically opposite points of the latter. Because these racks 25 and 26 are mounted in the swivel head 1, they are always parallel to the center plane 27 of the cutter arm 9 in all angular positions of the latter and forces exerted in the longitudinal direction of the cutter arm act in the longitudinal direction of the racks 25 and 26 and are taken up as flank and/or face pressures by the teeth. Two piston members 28, 29 or 30, 31 are connected to each rack 25 or 26 and coaxial thereto. The working chambers adjoining these piston members are designated 32, 33, 34 and 35. Hydraulic pressure applied to the working chambers 32 and 35 at the same time causes the cutter arm to perform an angular movement in the counterclockwise sense in FIG. 3. Hydraulic pressure applied to the working chambers 33 and 34 at the same time causes the cutter arm to perform an angular movement in the clockwise sense. The piston means for actuating the rack 25 thus consist of two piston members 28 and 29, and the piston means for actuating the rack 26 consist of two piston members 30 and 31. Pressure can be applied to each of said piston members 28 to 30 only at one end thereof. To ensure that pressure will be properly applied to the working chambers adjoined by these piston members, each of the working chambers 32 and 33 adjoined by the piston members 28 and 29, respectively, is in hydraulic communication with the opposite one of the working chambers 35 and 34 which are adjoined by the piston members 31 and 30, respectively. This means that there is a hydraulic communication between the working chambers 32 and 35 and between the working chambers 33 and 34. As a result, the forces acting in the longitudinal direction of the cutter arm 9 are taken up by the pressures in the working chambers 33 and 35 so that the swivel head 1 is supported in a radial direction against forces exerted by the cutter arm 9.

The hydraulic actuators 15 which comprise the pistons 14 for imparting an angular movement to the cutter arm 9 about the horizontal axis 7 are disposed on both sides of the pedestal 2. In a top plan view, the bearing disc 17 and the pinion 19 are disposed between these two hydraulic actuators 15 so that the overall height can be reduced and is determined only by the distance required between the pin 16 and the axis 7.

What we claim is:

1. A swivel mechanism for kerf-cutting machines of the kind comprising a frame, a cutting tool, a cutter arm carrying the cutting tool and pivoted to a swivel head on a horizontal axis for vertical angular movement, said swivel head being pivoted on an approximately vertical axis to a bearing disc which is rigidly connected to the frame of the cutting machine and has an outer annular zone that is engaged on both sides by sliding surfaces of the swivel head, and swivel drive means for imparting angular movements to the swivel head, characterized in that the swivel drive means comprise two racks which are mounted in the swivel head for movement in mutually opposite directions parallel to the vertical center plane of the cutter arm, each rack being connected to at least one piston member of a hydraulic actuator and each working chamber adjoining a piston member for actuating one rack being in hydraulic communication with the opposite working chamber adjoined by the piston for actuating the other rack, the piston means for actuating each rack comprising two coaxial piston members which are connected by the respective rack, each of said piston members being adapted to be subjected to hydraulic pressure only at one end thereof, and the working chambers associated with said piston members being adjoined by those end faces thereof which are remoted from the respective rack, and a pinion connected to and coaxial with the bearing disc and in mesh with said racks at diametrically opposite points of said pinion, the outside diameter of the bearing disc exceeding the pitch diameter of the pinion and the bearing disc and the pinion being annular and screw-connected to a pedestal which is rigidly connected to the frame of the cutting machine.

2. A swivel mechanism according to claim 1, characterized in that the pinion which is connected to and coaxial with the bearing disc is closely spaced above the latter.

3. A swivel mechanism according to claim 1, characterized in that the bearing disc and the pinion are disposed in a top plan view between two hydraulic actuators for imparting a vertical angular movement to the cutter arm about a horizontal axis.

* * * * *